US006786426B1

(12) United States Patent
Trapp

(10) Patent No.: US 6,786,426 B1
(45) Date of Patent: Sep. 7, 2004

(54) FIRE APPARATUS MONITOR

(75) Inventor: James M. Trapp, Galien, MI (US)

(73) Assignee: Elkhart Brass Manufacturing Co., Elkhart, IN (US)

( * ) Notice: Subject to any disclaimer, the term of this patent is extended or adjusted under 35 U.S.C. 154(b) by 53 days.

(21) Appl. No.: 10/217,684

(22) Filed: Aug. 13, 2002

(51) Int. Cl.[7] ..... B67D 5/08

(52) U.S. Cl. ..... 239/71; 169/51; 169/52; 169/67; 403/27

(58) Field of Search ..... 239/71, 74; 169/24, 169/25, 46, 51, 52, 67; 285/277, 317, DIG. 22, 168, 921; 403/27, 6

(56) References Cited

U.S. PATENT DOCUMENTS

| | | | | |
|---|---|---|---|---|
| 1,923,588 A | | 8/1933 | Robinson | 299/73 |
| 2,067,044 A | | 1/1937 | Corley | 299/73 |
| 2,501,639 A | | 3/1950 | Warren | 299/73 |
| 2,520,215 A | | 8/1950 | Kerr | 285/97.3 |
| 2,660,456 A | | 11/1953 | Meddock | 284/18 |
| 2,998,199 A | | 8/1961 | Miscovich | 239/587 |
| 3,011,239 A | | 12/1961 | Price et al. | 24/211 |
| 3,796,448 A | | 3/1974 | Ringkamp | 285/317 |
| 4,124,228 A | | 11/1978 | Morrison | 285/1 |
| 4,392,618 A | | 7/1983 | Evans et al. | 239/461 |
| 4,674,686 A | | 6/1987 | Trapp | 239/279 |
| 4,789,101 A | * | 12/1988 | Kempf | 239/242 |
| 4,793,557 A | * | 12/1988 | Marchese et al. | 239/587.3 |
| 4,936,507 A | * | 6/1990 | Weinstein | 239/71 |
| 5,488,995 A | * | 2/1996 | Kuwahara | 169/24 |
| 6,006,841 A | * | 12/1999 | Hunke | 169/24 |
| 6,138,767 A | * | 10/2000 | La Vergne | 169/15 |
| 6,354,320 B1 | * | 3/2002 | Kolacz et al. | 137/38 |

FOREIGN PATENT DOCUMENTS

| | | | |
|---|---|---|---|
| DE | 873045 | | 4/1953 |
| GB | 1139439 | | 1/1969 |
| JP | 02116650 A t | * | 5/1990 |

* cited by examiner

*Primary Examiner*—William E. Tapolcai
*Assistant Examiner*—Mohammad M. Ali
(74) *Attorney, Agent, or Firm*—Van Dyke, Gardner, Linn & Burkhart, LLP

(57) ABSTRACT

A fire-fighting monitor for directing the flow of fluid from a mount includes a monitor housing having an inlet, which is adapted to receive the mount for receiving fluid from the mount, and an outlet in fluid communication with the inlet for discharging fluid from the housing. The monitor also includes a latch mechanism for releasably engaging the mount. The latch mechanism extends through the housing for releasably engaging the mount. The monitor also includes an indicator means for providing a positive indication of when the latch mechanism is fully engaged with the mount.

37 Claims, 14 Drawing Sheets

FIRE APPARATUS MONITOR

TECHNICAL FIELD AND BACKGROUND OF THE INVENTION

The present invention relates a monitor and, more particularly, to a portable fire-fighting monitor which can be mounted on a truck or may be mounted on a ground stand.

Portable fire-fighting monitors are specialized fire-fighting equipment which are used in conjunction with a nozzle to direct water at a high flow rate, such as 350 to 1000 gallons per minute. Portable monitors are typically interchangeable between a pumper-mount on a truck and a portable-mount, such as described in U.S. Pat. No. 4,674,686, which is incorporated by reference herein in its entirety. To facilitate installation, most portable monitors incorporate a disconnect mechanism, which permits the monitor to be quickly mounted on or dismounted from a respective mount but which provides a secure connection between the monitor and the mount. As described in the '686 patent, portable monitors may include latch pins, which secure the monitor in place during fire-fighting operation and yet provide for a quick disconnect so that the monitor can be removed and remounted as desired.

However, it has been found on occasion an operator may not have the latch mechanism fully engaged with the respective mount. In order to achieve the flow rates normally associated with monitors, water that is pumped through the monitor is under high pressure. Therefore, if the latching mechanism is not properly latched, the monitor may leak.

Consequently, there is a need for a portable monitor that provides the operator of the monitor a quick connect or disconnect latching mechanism but also a means to confirm that the latching mechanism is fully engaged with its respective mount, preferably before water is pumped through the monitor.

SUMMARY OF THE INVENTION

According to one form of the present invention, a fire-fighting monitor for directing the flow of fluid from a mount includes a monitor housing having an inlet, which is adapted to receive the mount for receiving fluid from the mount, and an outlet in fluid communication with the inlet for discharging fluid from the housing. The monitor also includes a latch mechanism for releasably engaging the mount. The latch mechanism extends through the housing for releasably engaging the mount. The monitor also includes an indicator means for providing a positive indication of when the latch mechanism is fully engaged with the mount.

In one aspect, the indicator means comprises an indicator means for providing a positive visual indication of when the latch mechanism is fully engaged with the mount.

In other aspects, the latch mechanism comprises a latch housing, which includes the indicator means. In addition, the latch mechanism further comprises a latch pin that is movable in the monitor housing between an extended position for engaging the mount and a retracted position wherein the latch pin is disengaged. In one example, at least a portion of the latch pin is movable between the monitor housing and the latch housing.

In yet further aspects, the indicator means comprises at least one opening in the latch housing. The opening provides a visual indication of when the latch mechanism is in the extended position wherein the latch mechanism is fully engaged with the mount.

According to yet other aspects, the monitor housing includes a bore, with the latch pin supported for reciprocal movement in the bore from the retracted position to the extended position. In one form, the latch pin is biased to the extended position by a spring. For example, the spring may be mounted on the latch pin. In further forms, the monitor includes a cable wire, which is coupled to the latch pin and to a driver. The driver selectively increases tension on the cable to move the latch pin to the retracted position when the tension overcomes the spring force of the spring.

According to yet another aspect, a fire-fighting monitor includes a monitor housing having an inlet for receiving fluid and an outlet in fluid communication with the inlet for discharging fluid from the housing. The monitor also includes a latch mechanism for releasably engaging a mount. The latch mechanism includes a latch housing and a latch pin extending through the latch housing and the monitor housing for releasably engaging the mount. In this form, the latch housing has an indicator that provides a positive indication of when the latch pin is fully engaged with the mount.

In one aspect, the indicator comprises an opening in the latch housing and provides at least a positive visual indication or a tactile indication of when the latch mechanism is fully engaged with the mount.

In a further aspect, the latch housing includes an annular member, a base, and at least one member, which connects the annular member to the base. The member defines a passageway coaxial with the bore of the monitor housing for receiving a portion of the latch pin. The member also includes an opening in communication with the passageway whereby the position of the latch pin is viewable through the opening to provide a visual indication of when the latch pin is moved to the extended position.

It can be appreciated that the monitor of the present invention provides a quick disconnect and connect mechanism that permits the monitor to be quickly mounted on a mount, such as a pumper mount of a fire truck, and further a monitor that incorporates an indicator to provide, for example, a visual indication to an operator of when the latch mechanism is fully engaged with the mount. These and other objects, advantages, purposes, and features of the invention will become more apparent from the study of the following description taken in conjunction with the drawings.

DETAILED DESCRIPTION OF THE PREFERRED EMBODIMENTS

The numeral 10 generally designates a portable fire-fighting monitor of the present invention. As will be more fully described in reference to FIG. 2, monitor 10 may be mounted on a fixed mount 12, such as on a nozzle of a fire truck, or on a portable mount 14, which arc commonly known in the art. Fire-fighting monitor 10 is adapted to releasably mount on the respective fixed or portable mount using a quick connect or disconnect latching mechanism and, further, in a manner that provides a positive indication to an operator who is mounting the monitor that the latching mechanism is properly engaged with the respective mount, thereby minimizing potential leakage from monitor when the water is pumped through the monitor.

Figure 3:
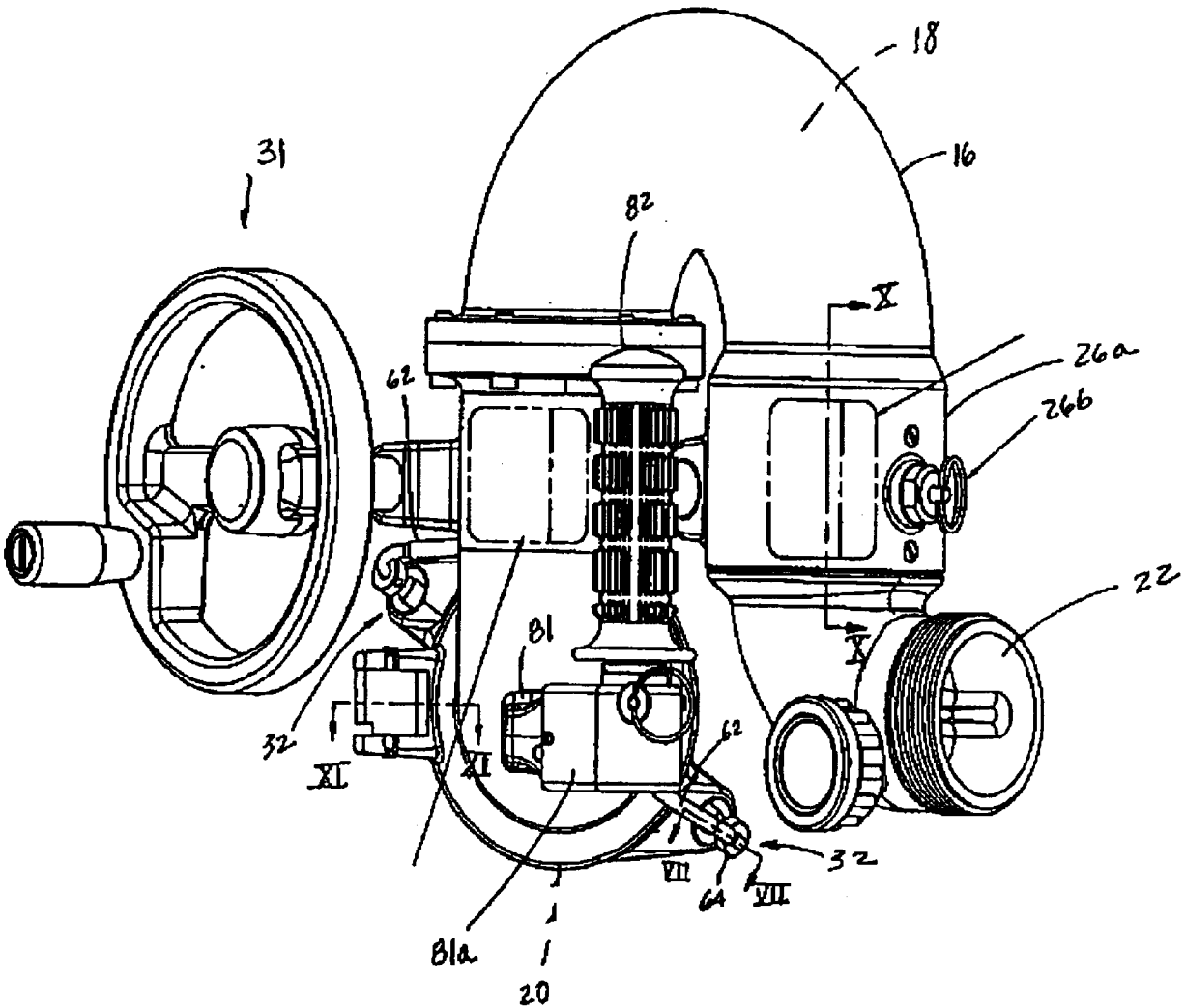
FIG. 3 is a top plan view of the monitor of FIG. 1.
Figure 4:
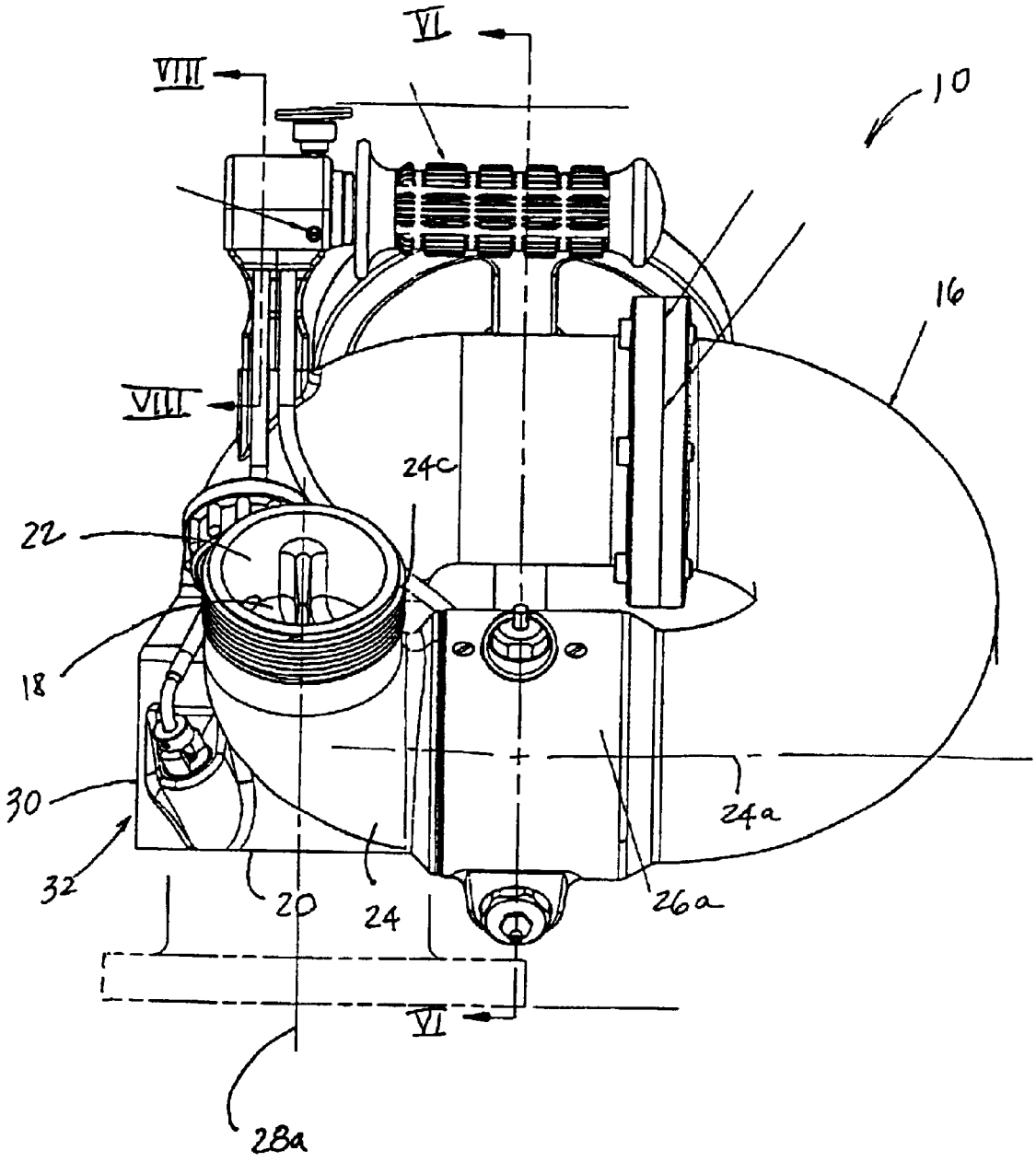
FIG. 4 is a side elevation view of the monitor of FIG. 1.

Referring to FIGS. 3 and 4, monitor 10 includes a housing 16 with a passageway 18 that extends from an inlet 20 to an outlet 22. A nozzle (not shown) is attached to housing 12 at outlet 22 and directs fluid flow from the outlet toward a desired target, such as the fire area. Housing 16 is formed from a plurality of elbow components including an outlet elbow 24, which comprises a 90° elbow, an intermediate elbow 26, which comprises a 180° elbow, and an inlet elbow 28, which comprises a 90° elbow and includes an enlarged collar 30 for mounting monitor 10 to a respective mount. Outlet elbow 24 is rotatably mounted to intermediate elbow 26 and is adjusted about a generally horizontal axis 24*a* by a drive mechanism 31, which will be more fully described below. As noted above, monitor 10 is releasably mountable to the respective mount and includes a plurality of releasable latch mechanisms 32 for engaging the respective mount.

Figure 5:
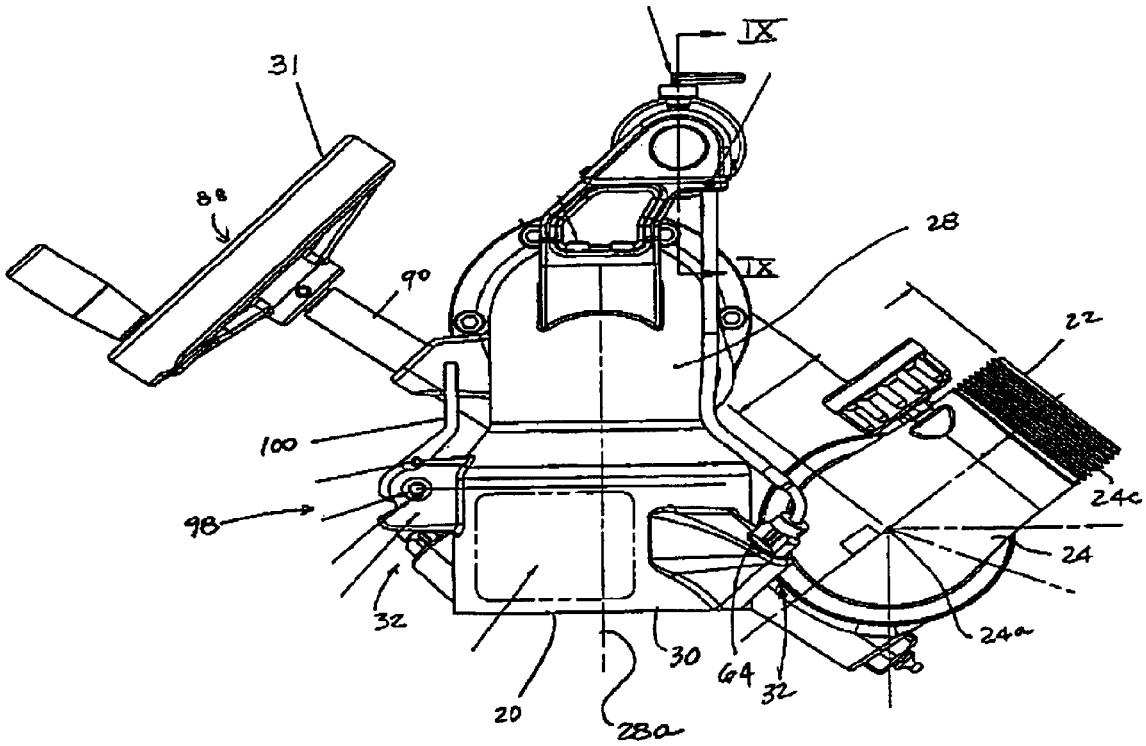
FIG. 5 is another side elevation view of the monitor of FIG. 1.
Figure 6:
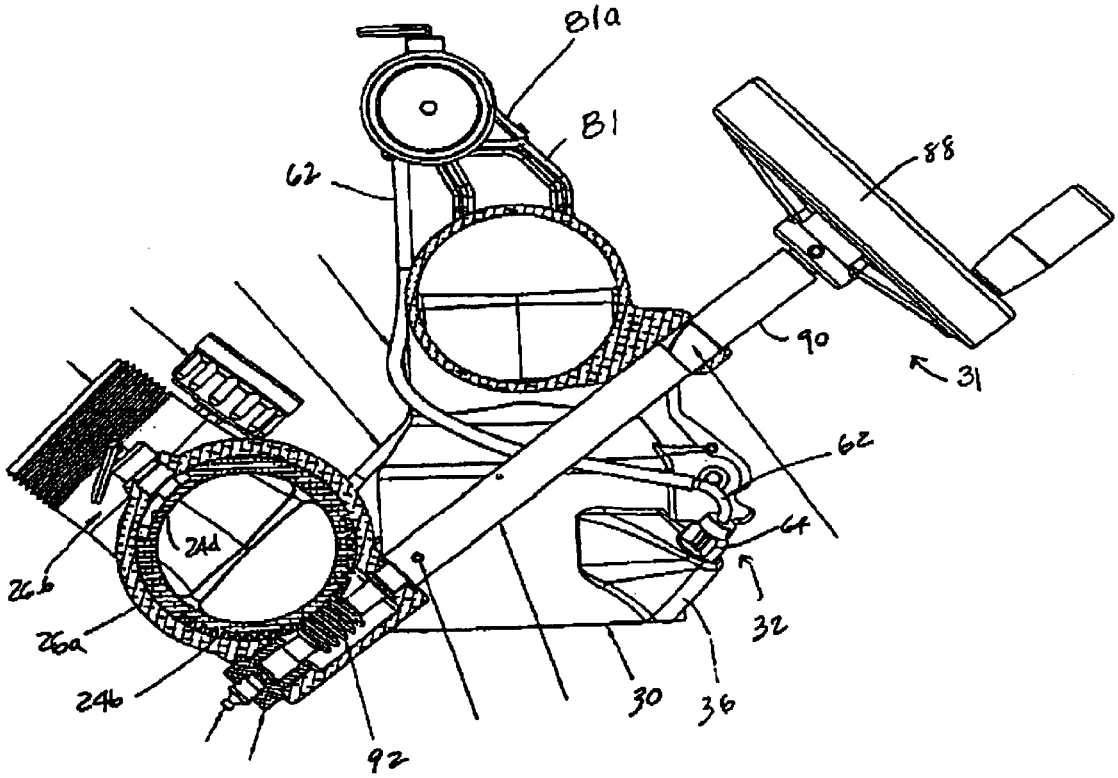
FIG. 6 is a cross-section view taken along line VI—VI of FIG. 5.
Figure 15:
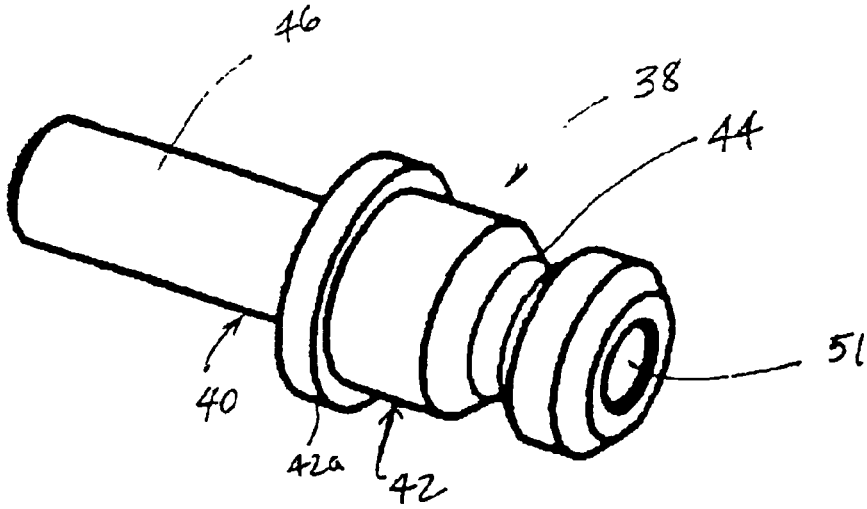
FIG. 15 is an enlarged perspective view of the latch pin.
Figure 16:
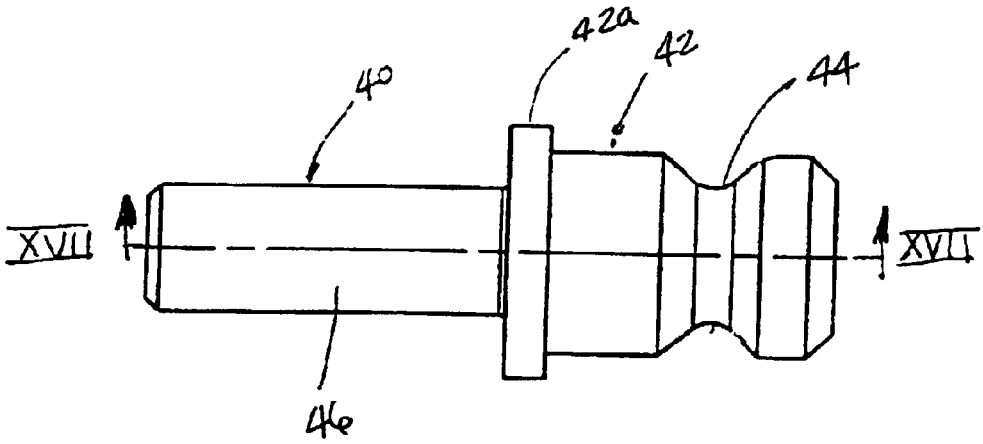
FIG. 16 is a side view of the latch pin of FIG. 15.
Figure 17:
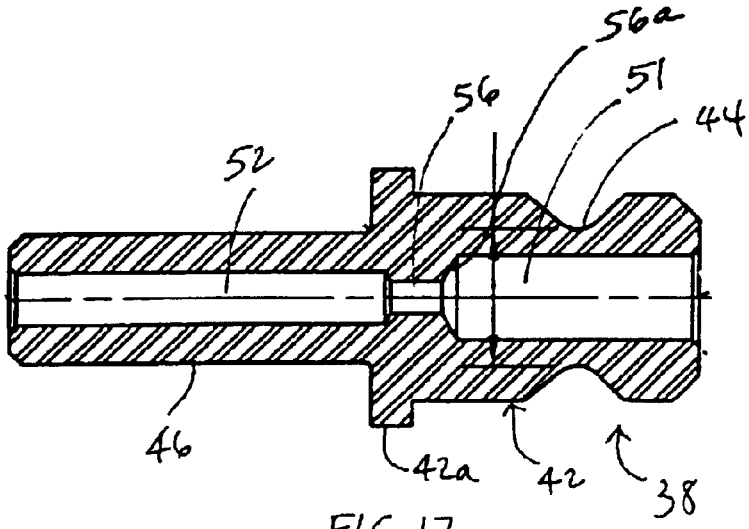
FIG. 17 is a cross-section view taken along line XVII—XVII of FIG. 16.

Referring to FIGS. 4–6, collar 30 includes a plurality of bores 34 which extend through enlarged flanges 36 provided in or otherwise formed on collar 30 and which extend generally downwardly towards inlet 20. Positioned in each bore is a latch pin 38 of the respective latch mechanism. Referring to FIGS. 15–17, latch pin 38 includes a generally cylindrical body 40 with a flanged head 42 and a base 46. Latch pin 38 is preferably formed from a hard material, such as metal, including stainless steel. Flanged head 42 includes a circumferential groove 44 for engaging the mount, which will be more fully described below. Base 46 has a smaller diameter than flanged head 42 to provide a seat or an abutment for a spring 48 (FIG. 6), which is mounted on base 46 of latch pin 38 and provides a spring force that urges latch pin 38 in an extended position for engagement with the respective mount. Flange 42*a* of flanged head 42 also provides a stop for latch pin 38 when latch pin 38 is in its extended position in bore 34 and engages an annular step 50 provided in bore 34. To retract latch pin 38, latch pin 38 is coupled to cable wire 58.

As best seen in FIG. 17, latch pin 38 includes a passageway or a bore 51 extending therethrough for receiving cable wire 58, which is used to move latch pin 38 against the force of spring 48 to a retracted position in bore 51. Bore 51 includes a first bore section 52 in base 46 and a second bore section 54 in flanged head 42, which has a larger diameter than the first bore section and is connected to the first bore section via a reduced diameter intermediate bore section 56. Intermediate bore section 56 defines an annular shoulder 56*a*, which provides an abutment for the end of cable wire 58, which includes an enlarged end or stop 60. When cable wire 58 is tensioned, therefore, the end of cable wire 58 abuts shoulder 56*a* to retract pin 38. When the tension is released, latch pin 38 moves under the force of spring 48 from its retracted position within bore 34 to an extended position wherein flanged head 42 projects into bore 30*a* of collar 30 for engagement with the respective mount. As will be more fully described below, the tension on cable wire 58 is supplied by a rotatable shaft or drum.

Figure 18:
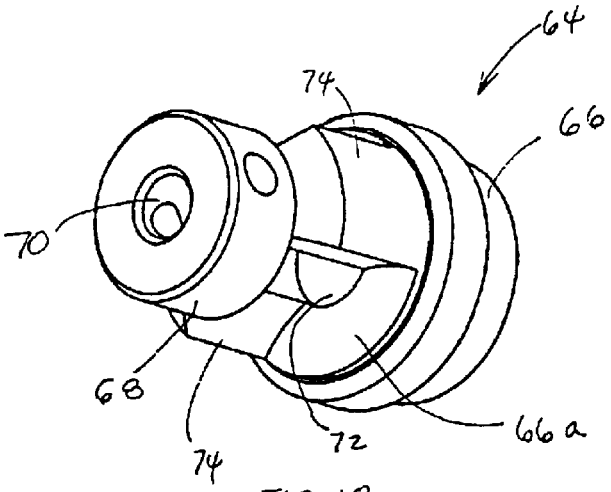
FIG. 18 is an enlarged perspective view of the cap of the latch pin of the latch assembly.
Figure 19:
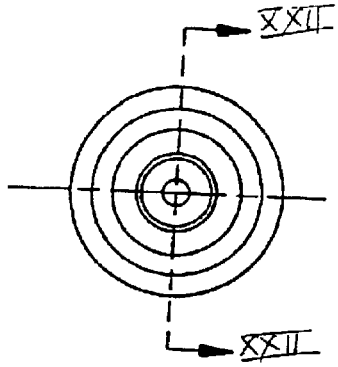
FIG. 19 is a top plan view of the cap of FIG. 18.
Figure 21:
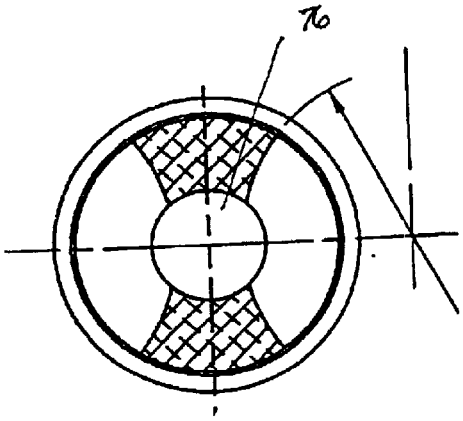
FIG. 21 is a cross-section view taken along line XXI—XXI of FIG. 20.
Figure 20:
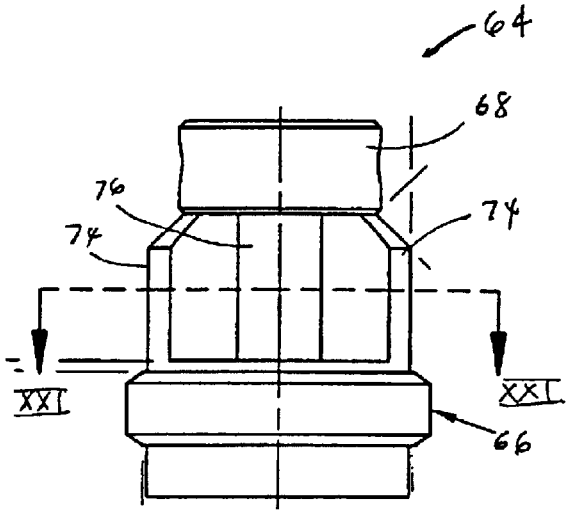
FIG. 20 is a side elevation view of the cap of FIG. 18.
Figure 22:
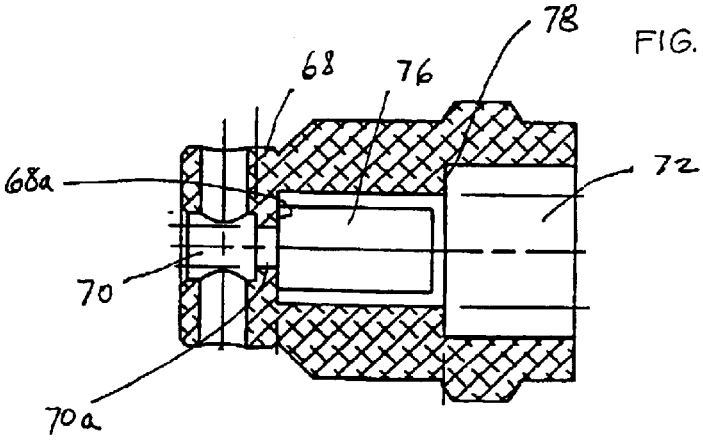
FIG. 22 is a cross-section taken along line XXII—XXII of FIG. 19.

As best seen in FIG. 6, latch mechanism 32 includes a housing 64. Housing 64 is preferably formed from a hard material, such as metal including aluminum, and is mounted to flange portion 36. Housing 64 provides a terminal for sheave 62 of cable wire 58 and, further, houses latch pin 38 and spring 48. Furthermore, housing 64 retains spring 48 on latch pin 38 and provides an abutment for spring 48 so that spring 48 is captured between flanged head 42 and the abutment provided by housing 64. Referring to FIGS. 18, 20, and 22, housing 64 includes a cylindrical base 66, which mounts to flange 36 of collar 30 and includes a passageway 72, which is coaxial with bore 34. Housing 64 further includes an annular member or guide 68 that includes a passageway 70, which is generally coaxial with passageway 72 formed in base 66. Annular member 68 and base 66 are interconnected by arcuate side members 74 that define therebetween an intermediate passageway 76, which is similarly coaxial with passageways 70 and 72. In addition, side members 74 are radially spaced around passageway 76 to define therebetween spaces or openings that are in communication with passageway 76 to form windows to provide a positive visual indication of the engagement of the latch pin, as will be more fully described below.

Passageway 76 is sized to receive base portion 46 of latch pin 38 but has a reduced diameter so as to provide an abutment 78 for flanged head 42 and, further, for spring 48. In this manner, when cable wire 58 is pulled, latch pin 38 will be retracted into bore 34, with spring 48 compressed against abutment 78 by flange 42*a* and with base 46 retracted into passageway 76 of housing 64. When the tension on cable wire 58 is released, spring 48 will urge flanged head 42 to extend through bore 34 and, further, to extend into bore 30*a* of collar 30 for engagement with the respective mount. As best seen in FIG. 22, bore 70 is sized to receive cable sheath 62 but includes a reduced diameter portion 70*a*, which permits wire cable 58 to extend through housing 64, while retaining cable sheave 62 in annular member 68 to thereby provide a terminal for the cable wire sheath 62.

Figure 12:
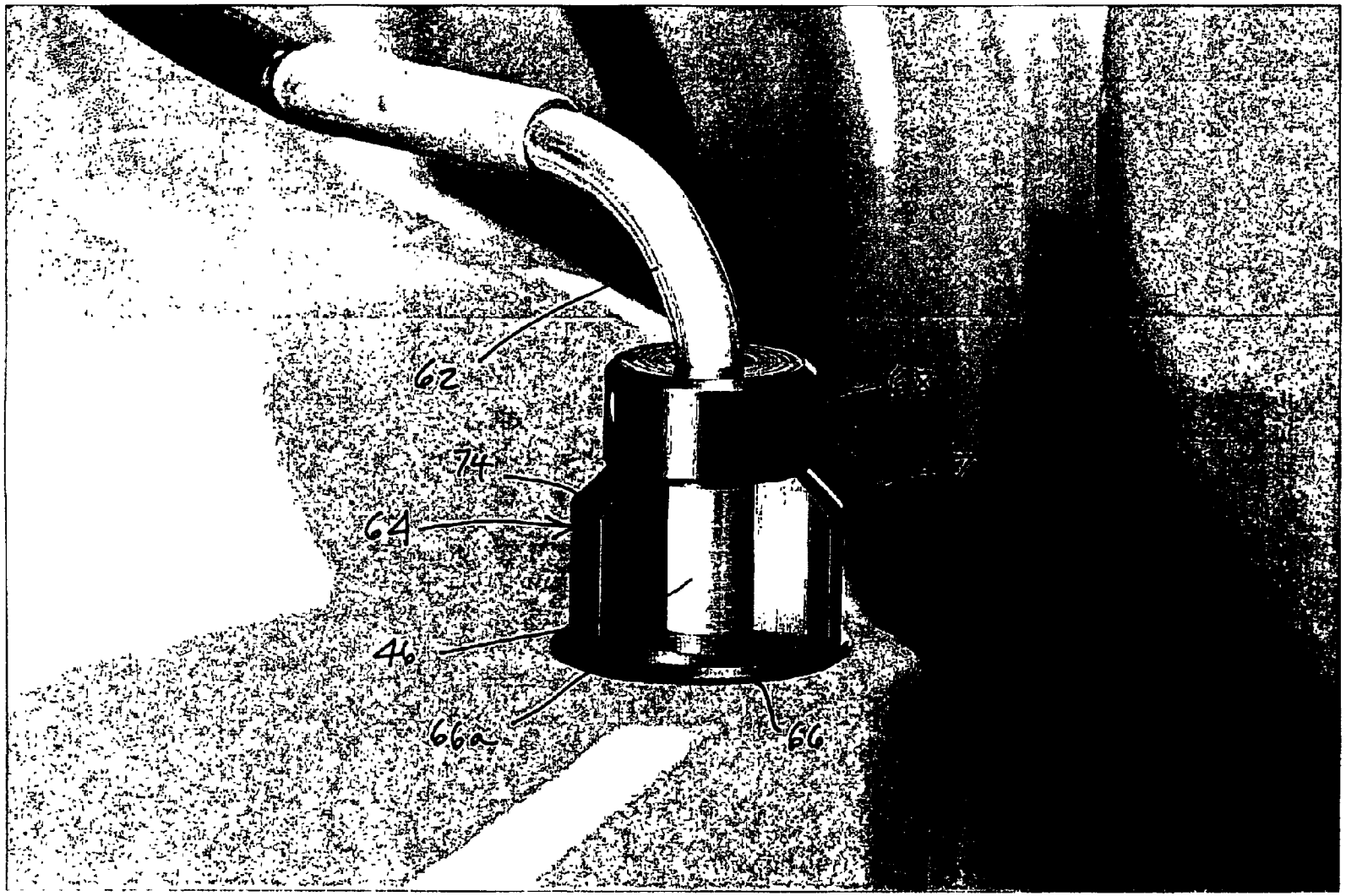
FIG. 12 is an enlarged perspective view of the latch pin mount illustrating the latch pin in a non-locking position.
Figure 13:
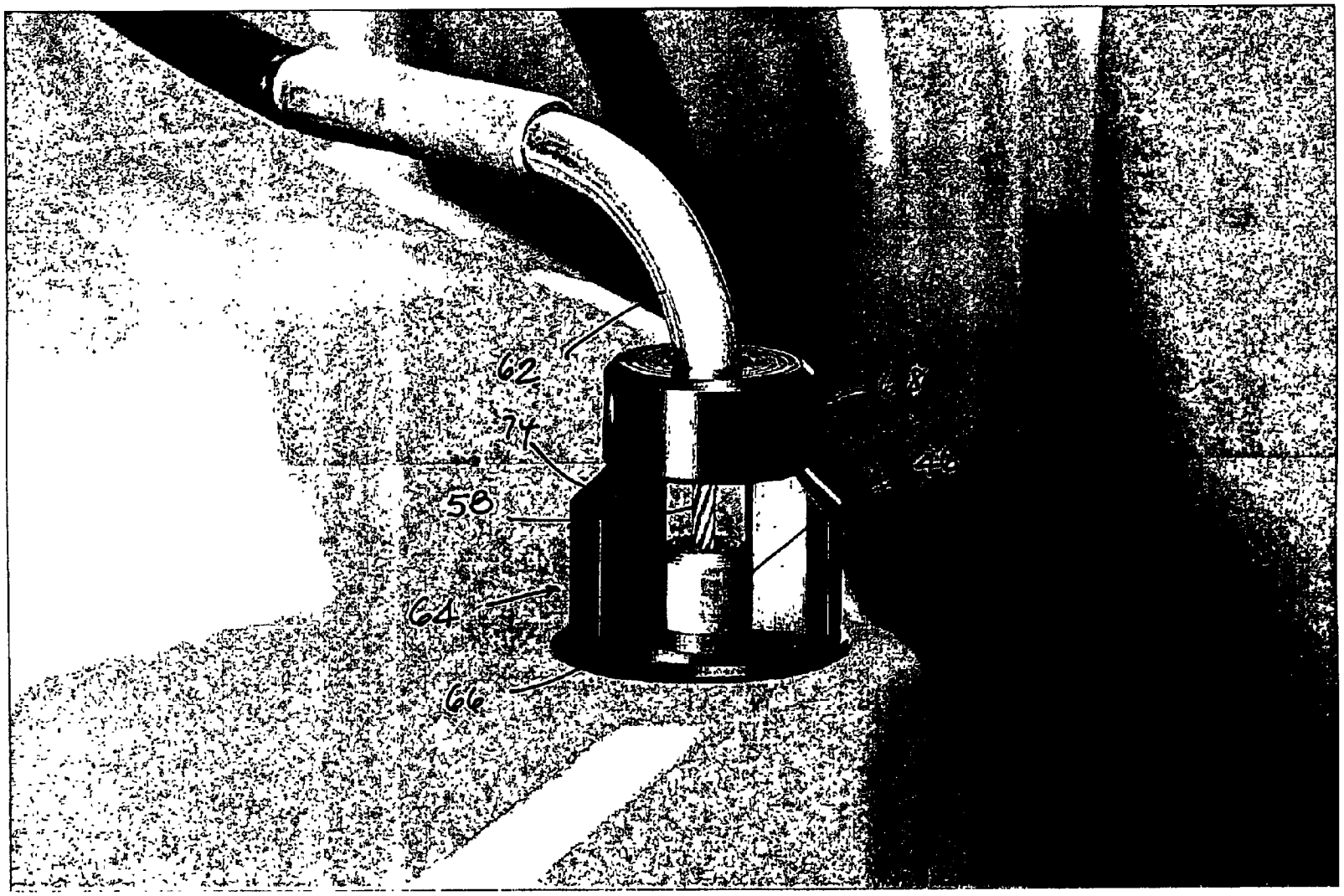
FIG. 13 is a similar view to FIG. 12 illustrating the latch pin in a partially-latched position.
Figure 14:
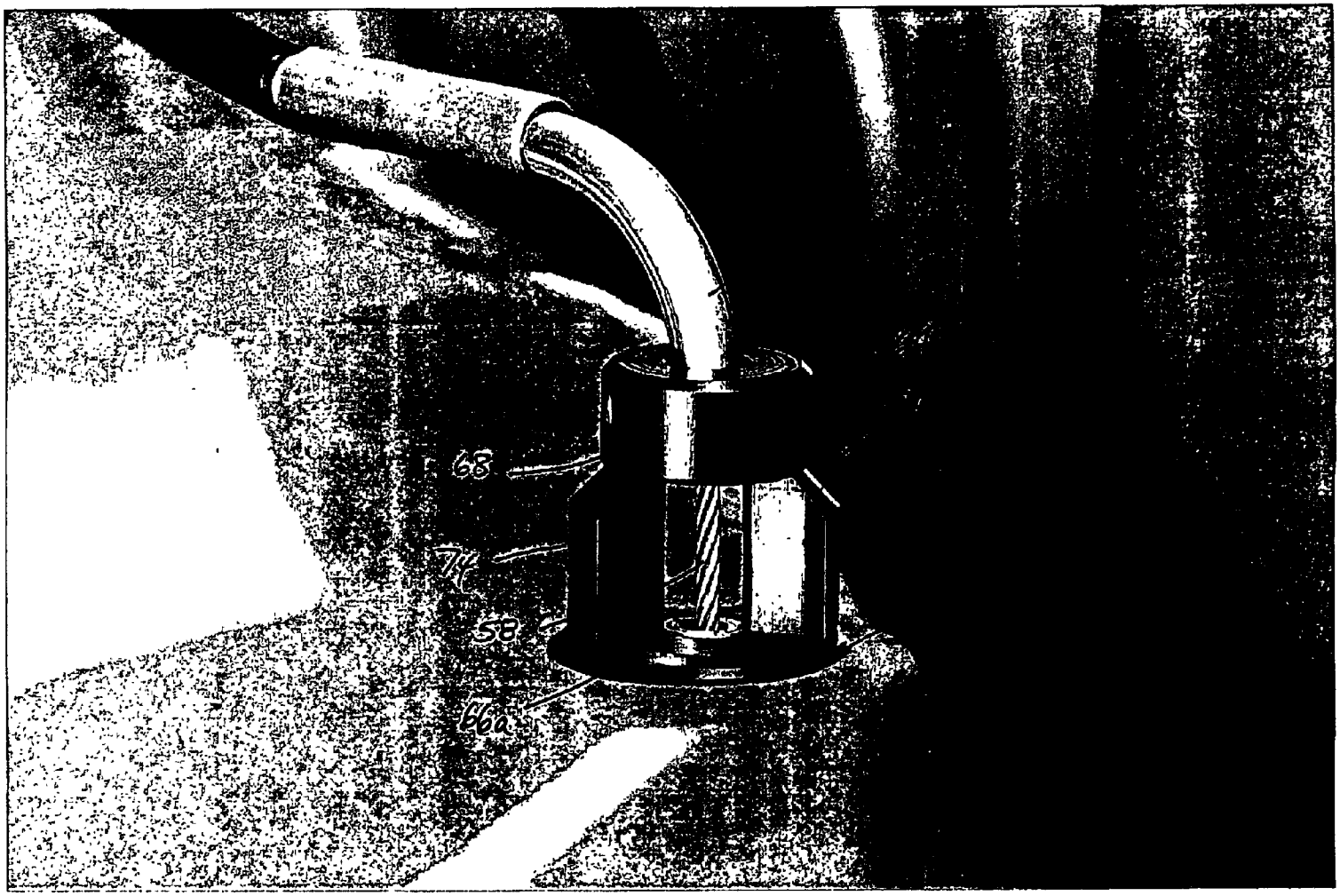
FIG. 14 is a similar view to FIGS. 12 and 13 illustrating the latch pin in a fully latched or locked position.

Referring to FIGS. 12–14, in addition to providing a terminal for sheath 62, housing 64 provides a positive visual indication of when latch pin 38 is fully engaged with the respective mount. As best seen in FIG. 14, when latch pin 38 is fully engaged with the respective mount, the distal end of base portion 46 of latch pin 38 is generally flush with the upper surface 66*a* of base 66, which can be viewed through housing 64 between side members 74. Upon disengagement of flanged head 42 with the respective mount, base portion 46 of latch pin 38 moves into passageway 76 and is readily visible through the space between members 74 (as shown in FIG. 13). When latch pin 38 is fully disengaged, base portion 46 of latch pin 38 substantially and completely fills passageway 76 and abuts lower surface 68*a* of annular member 68. Therefore, the openings between members 74 of housing 64 provide a visual indication of whether the latch pin is fully engaged with the respective mount. It should be understood that the number of side members may be increased and, further, the side members 74 may have different configurations. For example, side member 74 may have a cylindrical shape with straight or curved outer surfaces. In addition, though the illustrated embodiment depicts a monolithic housing—a housing that is formed or machined with a one-piece construction—housing 64 may comprise an assembly formed from one or more components. Other variations include the base portion 46 of latch pin 38 including a protection or tab that could extend through the space between the side member and optionally seat in a groove formed in base 66 to provide a different visual indication or a tactile indication of the full engagement of the latch pin with the mount. Alternately, the flange of collar 30 may include a window or the like to provide a visual or tactile indication.

Figure 8:
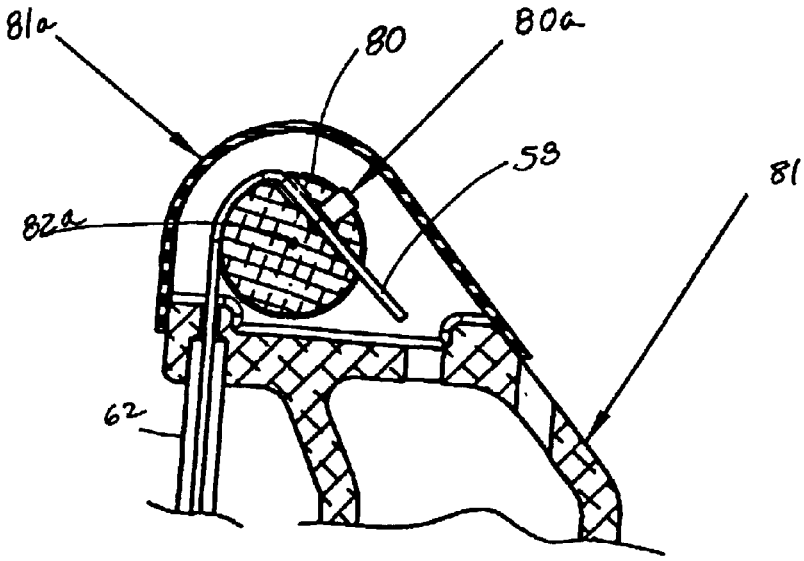
FIG. 8 is an enlarged cross-section taken along line VIII—VIII of FIG. 4.
Figure 9:
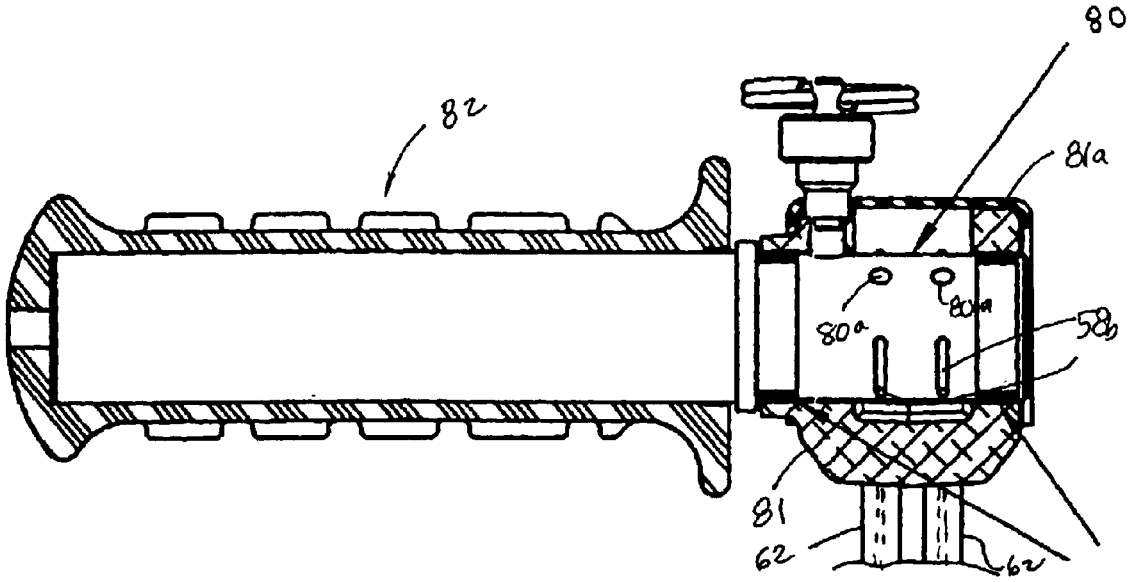
FIG. 9 is an enlarged cross-section taken along line IX—IX of FIG. 5.

As previously described, cable wire 58 is tensioned by a driver. In the illustrated embodiment, the driver comprises a shaft or drum 80 and a handle 82. Referring to FIG. 8, the proximal end of cable wire 58 is connected to shaft 80 by a set screw 80*a*. Shaft 80 is rotatably mounted to housing 16 by a bracket 81 and enclosed by a cover or housing 81*a*. In the illustrated embodiment, shaft 80 is rotatably mounted to inlet elbow 28 and, further, is coupled to handle 82, which upon rotation about a generally horizontal axis 82*a* causes shaft 80 to rotate thereby winding or unwinding cable wire 58 about shaft 80 to increase or decrease the tension on cable wire 58 to control the position of latch pin 38.

Figure 10:
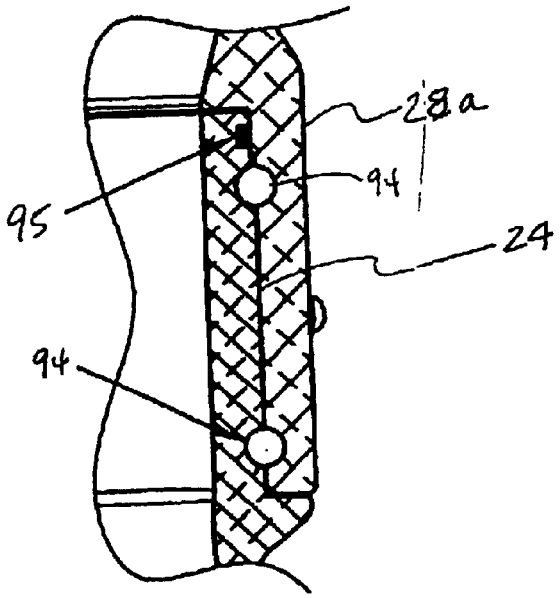
FIG. 10 is an enlarged cross-section taken along line X—X of FIG. 3.

As previously noted, outlet elbow 24 comprises a pivotal outlet elbow, which includes a first threaded portion 24*b* (FIG. 6), which is engaged by driver 31, and a second threaded portion 24*c* for mounting a nozzle onto monitor 10. As best seen in FIG. 6, driver 32 includes a hand wheel 88 that is mount on a shaft 90. Shaft 90 includes a worm screw 92 for engaging threaded portion 24*b* of elbow 24 so that when hand wheel 88 is rotated, worm screw 92 rotates elbow 24. As best seen in FIGS. 5 and 6, elbow 24 is mounted in an enlarged collar portion 26*a* of elbow 26 for rotation about horizontal axis 24*a* on bearings 94 (FIG. 10). A seal 95 is position between elbow 24 and collar 26*a* to seal the connection. Optionally, collar 26*a* supports one or more mechanical stops 26*b*, which extend into a groove 24*c* provided on elbow 24 to fix the position of elbow 24 with respect to collar 26*a*.

Figure 11:
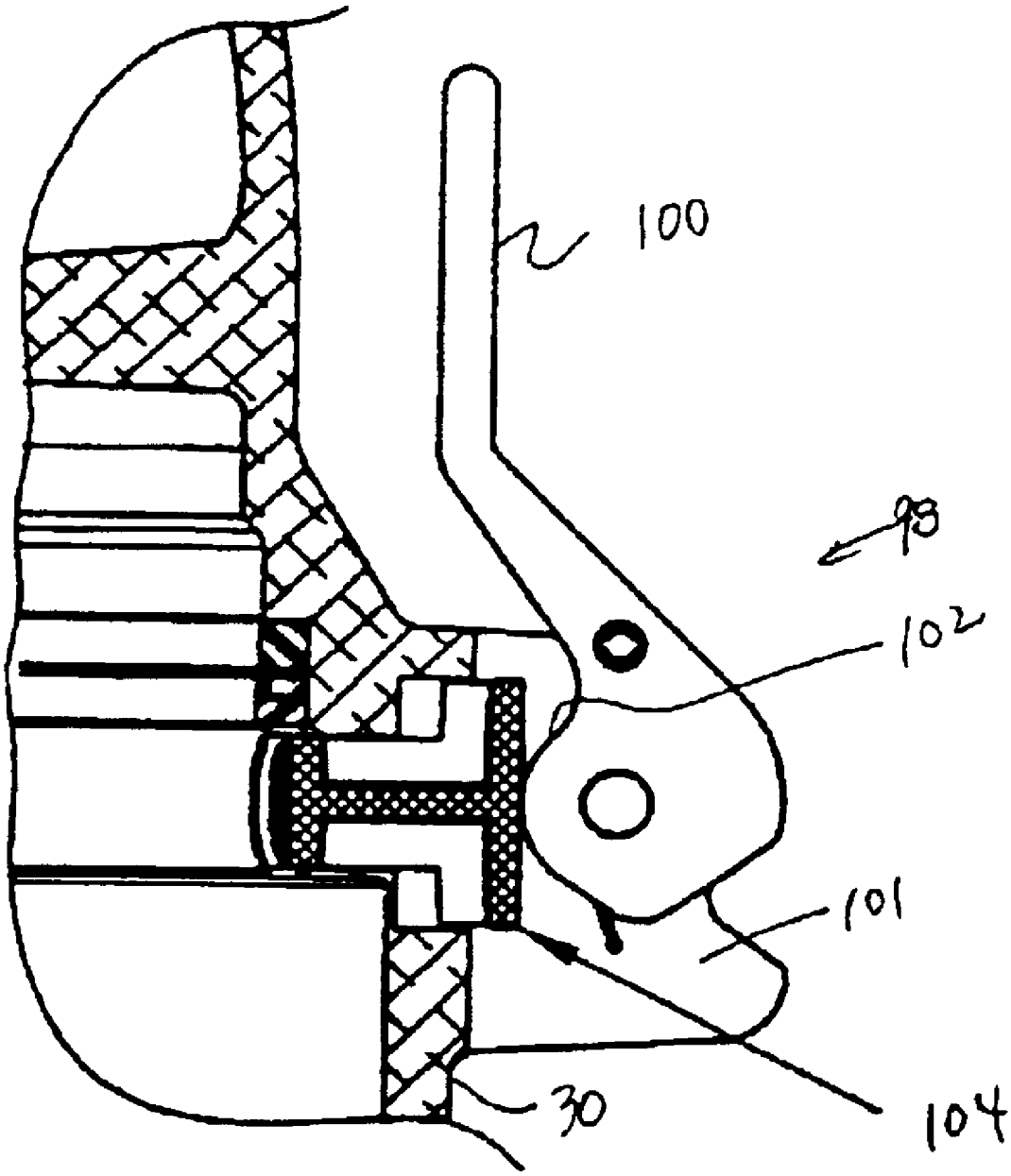
FIG. 11 is an enlarged cross-section taken along line XI—XI of FIG. 3.

Similarly, collar 30 of inlet elbow 28 optionally includes a mechanical locking mechanism 98, which locks monitor 10 on the respective mount to limit movement about vertical axis 28*a*. As best seen in FIGS. 5 and 11, mechanical locking mechanism 98 includes a lever arm 100 that is pivotally mounted to collar 30 on a bracket 101. Lever arm 100 includes a cam surface 102 that urges and actuates a locking member 104, which extends through collar 30, into frictional engagement with the respective mount that is positioned in bore 30*a* of collar 30 to thereby limit rotation of inlet elbow 28 about vertical axis 28*a*.

Figure 7:
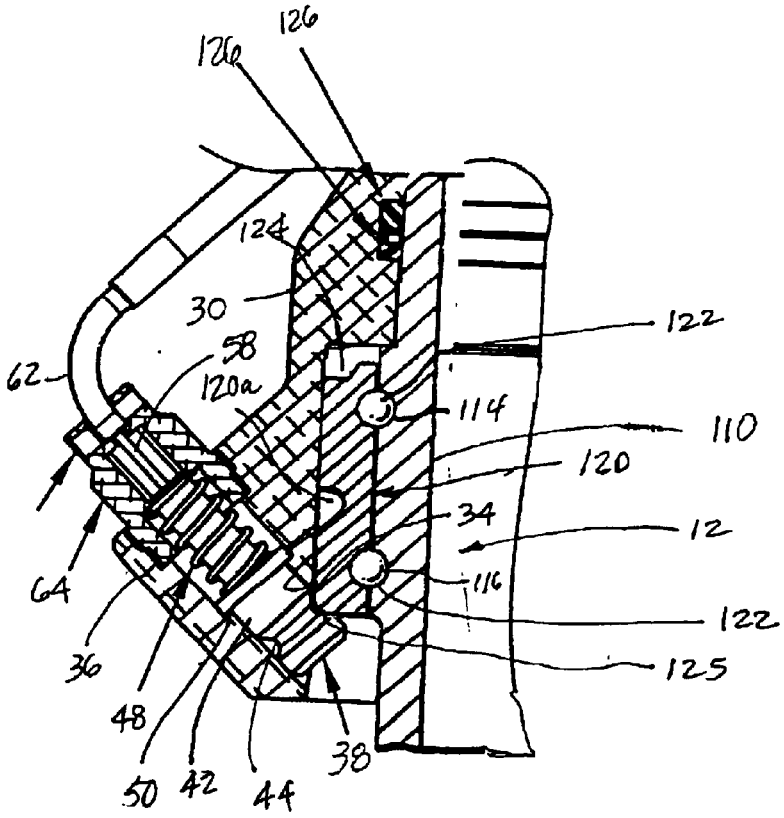
FIG. 7 is an enlarged cross-section view taken along line VII—VII of FIG. 3.

Referring again to FIG. 2, monitor 10 may be connected to either fixed mount 12, which is positioned to top a fire engine pumper or a portable mount 14. Mount 12 includes a conduit (not shown), which is in fluid communication with a water supplied contained within the pumper of the truck. Mount 12 also includes a cylindrical housing 106, which includes a pair of spaced apart annular grooves 112 and 114 (FIG. 7) that extend about housing 106. Monitor 10 is mounted on cylindrical housing 106 by a cylindrical swivel bearing 120, which is rotatable about housing 106 on bearings 122, which ride within respective grooves 112 and 114 formed in the cylindrical housing 110.

To mount monitor 10 on fixed mount 12, an operator first aligns the inlet opening 20 of inlet elbow 28 with housing 106 of fixed mount 12. Monitor 10 is then pushed down over the mount housing with the lower exposed ends of latching pins 38 first contacting the beveled end 124 of swivel bearing 120. This causes latch pins 38 to be cammed inwardly into bores 34, thereby compressing spring 48 until pins 38 clear the shoulder of swivel bearing 120. Once pin 38 clears the shoulder of swivel bearing 120, pins arc then moved to their extended or engaged position under the force of the springs in which the lower shoulder 125 of swivel bearing is seated in groove 44 of latch pin 38. When engaged, latch pins 38 firmly secure monitor 10 to mount 12. Preferably, collar 30 carries one or more seals to prevent water leakage between the monitor and the mount.

In addition, as an optional failsafe feature, swivel bearing 120 may include an exterior circumferential groove 120*a*, which prevents monitor 10 from being disengaged from the mount in the event that the monitor is not fully pushed onto the mount housing. Preferably, circumferential groove 120*a* includes a generally upper flat wall, which prevents the upward passage of the latch pins unless the latch pins are withdrawn by the turning of the handle 82.

To remove monitor 10 from mount 12, an operator rotates handle 82, which in turn rotates shaft 80 to wind cable wire or wires 58 about the shaft and thereby pull on latch pins 38 to move the pins against the force of springs 48 to their retracted unlatched positions shown in FIG. 12. The monitor is then pulled upwardly until it disengages from the fixed mount.

Figure 1:
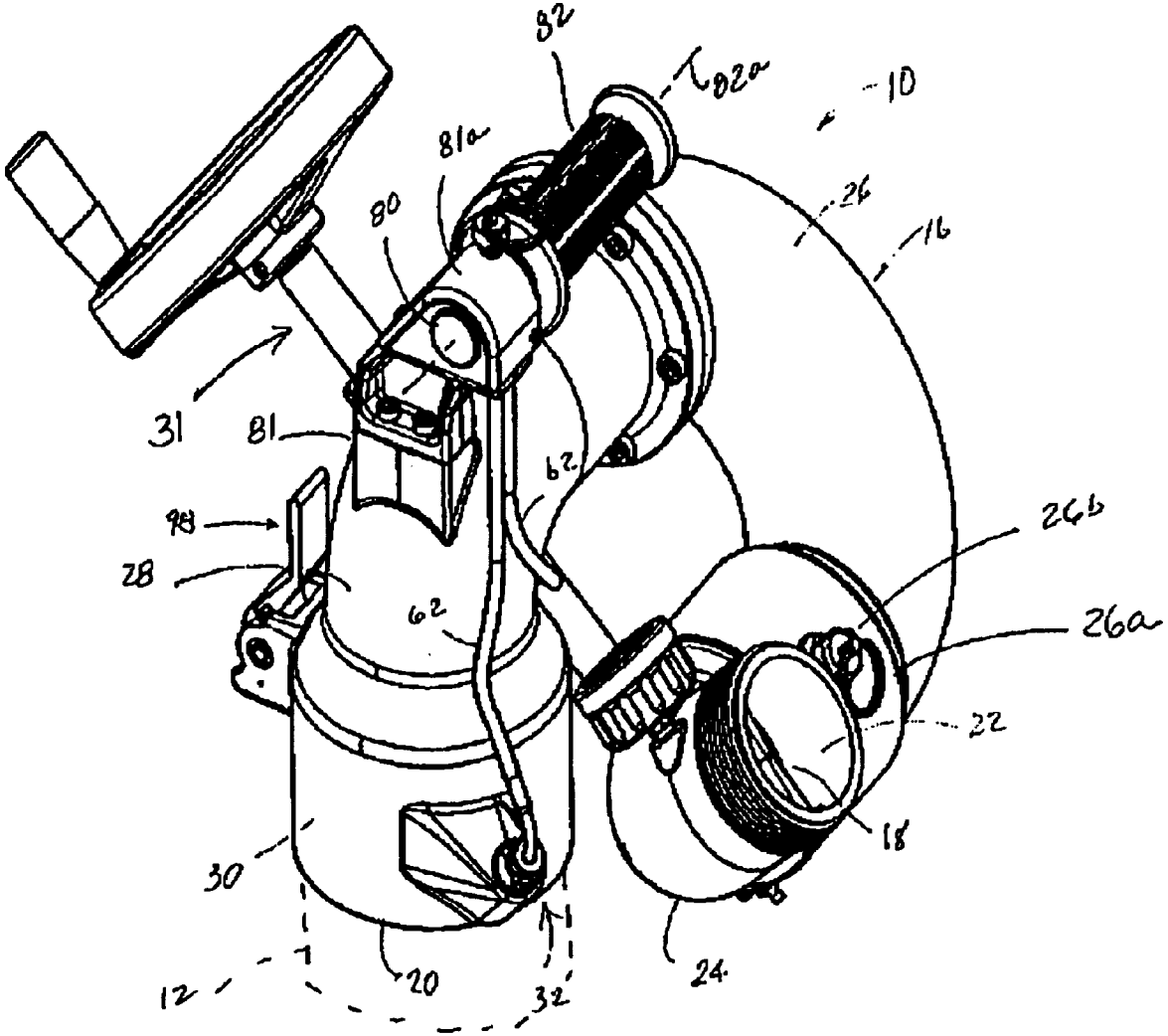
FIG. 1 is a perspective view of a fire apparatus monitor of the present invention.
Figure 2:
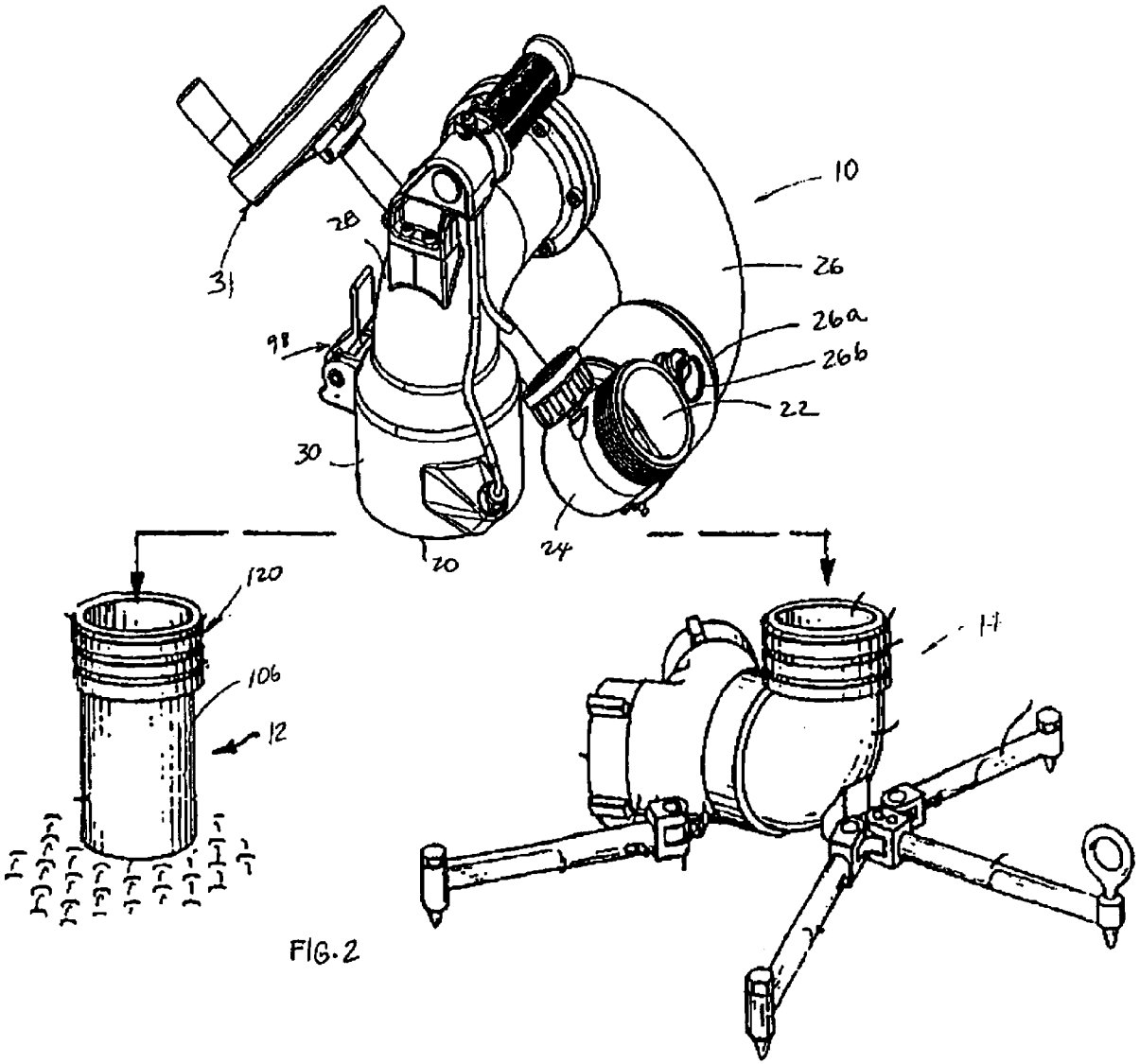
FIG. 2 is an exploded perspective view of the fire-fighting monitor of FIG. 1 and a fire truck mount and a portable mount.

Referring to FIG. 2, monitor 10 may be mounted on a portable ground support mount 14. Mount 14 includes a plurality of leg supports and a base inlet. The base inlet optionally includes two inlet ports, which are separated by a clapper valve, and is adapted for connection to the end of a fire hose, which may extend from a pumper of a truck. In some applications, only one inlet port will be used. The process of attaching and detaching monitor 10 from mount 14 is similar to the process described in reference to the fixed mount.

It should be understood, that other modifications and changes may be made without departing from the scope of the invention. For example, outlet elbow 26 may be driven by a motorized drive assembly, which may be actuated, for example, using remote controls. Furthermore, while the illustrated embodiment includes only two latch pins, it should be understood that additional latch pins may be added without departing from the scope of the invention. Moreover, additional articulating joints may be provided to increase the range of motion of the monitor.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow as interpreted under the principles of patent law including the doctrine of equivalents.

What is claimed is:

1. A fire-fighting monitor for directing the flow of fluid from a fluid source from a mount, said monitor comprising:

a monitor housing having an inlet for receiving fluid and an outlet in fluid communication with said inlet for discharging fluid from said housing, said inlet adapted to receive the mount;

a latch mechanism for releasably engaging the mount, said latch mechanism extending through said monitor housing for releasably engaging the mount, the engagement of the latch mechanism with the mount being internal to said monitor and not being visible exteriorly of said monitor; and indicator means for providing a positive indication of when said latch mechanism is fully engaged with the mount and when said latch mechanism is fully disengaged with said mount.

2. The fire-fighting monitor according to claim 1, wherein said indicator means comprises an indicator means for providing a positive visual indication of when said latch mechanism is fully engaged with or disengaged from the mount.

3. The fire-fighting monitor according to claim 1, wherein said latch mechanism comprises a latch housing, said housing including said indicator means.

4. The fire-fighting monitor according to claim 3, wherein said latch mechanism further comprises a latch pin, said latch pin being movable in said monitor housing between an extended position for engaging the mount and a retracted position wherein said latch pin is disengaged from said mount.

5. The fire-fighting monitor according to claim 4, wherein at least a portion of said latch pin is movable between said monitor housing and said latch housing.

6. A fire-fighting monitor for directing the flow of fluid from a fluid source from a mount, said monitor comprising:

a monitor housing having an inlet for receiving fluid and an outlet in fluid communication with said inlet for discharging fluid from said housing, said inlet adapted to receive the mount;

a latch mechanism for releasably engaging the mount, said latch mechanism extending through said monitor housing for releasably engaging the mount, and said latch mechanism comprising a latch housing; and indicator means for providing a positive indication of when said latch mechanism is fully engaged with the mount, wherein said indicator means comprises at last one opening in said latch housing, said opening providing a visual indication of when said latch mechanism is in said extended position wherein said latch mechanism is fully engaged with the mount.

7. The fire-fighting monitor according to claim 4, wherein said monitor housing includes a bore, said latch pin being supported for reciprocal movement in said bore from said retracted position to said extended position.

8. The fire-fighting monitor according to claim 4, wherein said latch pin is biased to said extended position by a spring.

9. The fire-fighting monitor according to claim 8, wherein said spring is mounted on said latch pin.

10. The fire-fighting monitor according to claim 4, further comprising a cable wire, said cable wire coupled to said latch pin and to a driver, said driver selectively increasing tension on said cable to move said latch pin to said retracted position when said tension overcomes the spring force of said spring.

11. A fire-fighting monitor for directing the flow of fluid from a fluid source from a mount, said monitor comprising:

a monitor housing having an inlet for receiving fluid and an outlet in fluid communication with said inlet for discharging fluid from said housing, said inlet adapted to receive the mount; and a latch mechanism for releasably engaging the mount, said latch mechanism including a latch housing and a latch pin extending through said latch housing and said monitor housing for releasably engaging the mount, the engagement of the latch pin with the mount being internal to said monitor and not being visible exteriorly of said monitor, and said latch housing including a window, said window providing a positive indication of when said latch pin is fully engage with the mount.

12. The fire-fighting monitor according to claim 11, wherein said window comprises an opening in said latch housing and providing one of a positive visual indication and a tactile indication of when said latch mechanism is fully engaged with the mount.

13. The fire-fighting monitor according to claim 12, wherein said opening provides a positive visual indication of when said latch mechanism is fully engaged with the mount.

14. The fire-fighting monitor according to claim 11, wherein said monitor housing includes a bore, said latch pin being supported for reciprocal movement in said bore from a retracted position to an extended position wherein said latch pin is engaged with the mount.

15. The fire-fighting monitor according to claim 14, wherein said latch pin is biased to said external position by a spring.

16. The fire-fighting monitor according to claim 15, wherein said spring is mounted on said latch pin.

17. The fire-fighting monitor according to claim 15, further comprising a cable wire, said cable wire coupled to said latch pin and to a driver, said driver selectively increasing tension on said cable to move said latch pin to said retracted position when said tension overcomes the spring force of said spring.

18. A fire-fighting monitor for directing the flow of fluid from a fluid source from am mount, said monitor comprising:

a monitor housing having an inlet for receiving fluid and an outlet in fluid communication with said inlet for discharging fluid from said housing, said inlet adapted to receive the mount, said monitor housing including a bore: and a latch mechanism for releasably engaging the mount, said latch mechanism including a latch housing and a latch pin extending through said latch housing and said monitor housing for releasably engaging the mount, said latch pin being supported for reciprocal movement in said bore from a retracted position to an extended position, and said latch housing including an annular member and a base and at least one member connecting said annular member to said base, said member defining a passageway coaxial with said bore for receiving a portion of said latch pin, and said member including an opening in communication with said passageway whereby the position of said latch pin is viewable through said opening to provide a visual indication of when said latch pin is moved to said extended position.

19. A fire-fighting apparatus comprising:

a mount comprising a cylindrical housing having an inlet in communication with a fluid source and an outlet; and a monitor mounted on said cylindrical housing for directing the flow of fluid from said mount, said monitor comprising:

a monitor housing having an monitor inlet for receiving fluid from said outlet of said mount and a monitor outlet in fluid communication with said monitor inlet for discharging fluid from said monitor housing, said inlet adapted to receive said cylindrical housing of said mount; and a latch mechanism releasably engaging said mount, said latch mechanism including a latch pin extending through a latch housing and sad monitor housing for selectively and releasably engaging said mount, the engagement of the latch pin with the mount being integral to said monitor and not being visible exteriorly of said monitor, and said latch mechanism having an indicator means providing a positive indication of when said latch pin is fully engaged with the mount, and said indicator means comprising a portion of said latch pin wherein said latch pin and said portion move together when said latch pin is moved to engage or disengage from said mount.

20. The fire-fighting apparatus according to claim 19, wherein said mount further includes an annular bearing, said latch pin engaging said bearing to thereby engage said mount.

21. The fire-fighting apparatus according to claim 19, wherein said said latch housing includes a window, said portion viewable through said window to provide a positive visual indication of when said latch pin is fully engaged with said mount.

22. The fire-fighting apparatus according to claim 21, wherein said latch housing includes at least one opening forming said window for viewing said portion to provide an indication of when said latch pin is fully engaged with said mount.

23. The fire-fighting apparatus according to claim 21, wherein said latch housing includes at least two openings forming two windows for viewing said portion to provide an indication of when said latch pin is fully engaged with said mount.

24. The fire-fighting apparatus according to claim 21, wherein said monitor housing includes a bore, said latch pin being supported for reciprocal movement in said bore from said retracted position to said extended position.

25. The fire-fighting apparatus according to claim 24, wherein said latch pin is biased to said extended position by a spring.

26. The fire-fighting apparatus according to claim 25, wherein said spring is mounted on said latch pin.

27. The fire-fighting apparatus according to claim 25, further comprising a cable wire, said cable wire coupled to said latch pin and to a driver, said driver selectively increasing tension on said cable to move said latch pin to said retracted position when said tension overcomes the spring force of said spring.

28. The fire-fighting apparatus according to claim 26, wherein said latch housing includes a base and an annular member spaced from said base to thereby define a space therebetween, said spring captured in said base and urging said pin to its extend position, and when said tension on said cable sufficient to compress said spring a portion of said latch pin is retracted into said space, said indicator providing a visual indicating of when said portion of said latch pin is moved into said space.

29. The fire-fighting monitor according to claim 1, wherein said latch mechanism includes a latch pin and a latch housing, said latch pin extending through said latch housing and said monitor housing to releasably engage the mount, said indicator means comprising a window in said latch housing and at least a portion of said latch pin, said portion being viewable through said window to provide a positive indication of when said latch pin is engaged or disengaged from said mount.

30. The fire-fighting monitor according to claim 29, wherein said portion comprises a base portion of said latch pin.

31. The fire-fighting monitor according to claim 29, wherein said housing includes an opening, said opening forming said window.

32. The fire-fighting monitor according to claim 29, wherein said housing includes a plurality of windows.

33. The fire-fighting monitor according to claim 6, wherein said latch mechanism includes a latch pin, said latch pin extending through said latch housing and said monitor housing to thereby releasably engage the mount, and said opening providing a visual indication of when said latch pin is fully engaged with the mount.

34. The fire-fighting monitor according to claim 33, wherein said latch pin includes a base portion, said base portion is visible through said opening, said base portion providing an indication of when said latch pin is fully engaged with the mount.

35. The fire-fighting apparatus according to claim 18, wherein said latch pin includes a base portion, said base portion of said latch pin being viewable through said window to provide a visual indication when said latch pin is moved to said extended position.

36. The fire-fighting apparatus according to claim 35, whereby the position of said portion viewable through said window provides a visual indication when said latch pin is fully engaged with or fully disengaged with the mount.

37. The fire-fighting apparatus according to claim 36, wherein said annular member includes a plurality of openings in communication with said passageway to form a plurality of windows whereby the position of said portion is viewable through said openings.

* * * * *

UNITED STATES PATENT AND TRADEMARK OFFICE

CERTIFICATE OF CORRECTION

PATENT NO. : 6,786,426 B1
APPLICATION NO. : 10/217684
DATED : September 7, 2004
INVENTOR(S) : James M. Trapp It is certified that error appears in the above-identified patent and that said Letters Patent is hereby corrected as shown below:

Column 3:
Line 30, “arc” should be --are--.

Column 6:
Line 24, “arc” should be --are--.

Column 7:
Line 55, Claim 6, “last” should be --lease--.

Column 8:
Line 21, Claim 11, “engage” should be --engaged--.
Line 36, Cliam 15, “external” should be --extended--.
Line 47, Claim 18, “am” should be --a--
Line 53, Claim 18, “:” should be --;--.

Column 9:
Line 15, Claim 19, “sad” should be --said--.
Line 18, Claim 19, “integral” should be --internal--.

Signed and Sealed this

Sixth Day of February, 2007

JON W. DUDAS
*Director of the United States Patent and Trademark Office*